United States Patent [19]

Fuller et al.

[11] 4,398,714

[45] Aug. 16, 1983

[54] BALL BASE CONSTRUCTION AND ANCHOR

[75] Inventors: Charles C. Fuller; James L. Hendrickson, both of Washington, Ill.

[73] Assignee: Safe-Base, Inc., Washington, Ill.

[21] Appl. No.: 242,160

[22] Filed: Mar. 9, 1981

[51] Int. Cl.[3] ..... A63B 71/02

[52] U.S. Cl. ..... 273/25

[58] Field of Search ..... 273/25

[56] References Cited

U.S. PATENT DOCUMENTS

| | | | |
|---|---|---|---|
| 2,695,784 | 11/1954 | Orsatti et al. | 273/25 |
| 3,204,958 | 9/1965 | Velasquez | 273/25 |
| 3,466,039 | 9/1969 | Golomb | 273/25 |
| 3,938,804 | 2/1976 | Willett | 273/25 |
| 4,045,022 | 8/1977 | Grant et al. | 273/29 R |

FOREIGN PATENT DOCUMENTS

| | | | |
|---|---|---|---|
| 413329 | 7/1934 | United Kingdom | 273/29 BB |

OTHER PUBLICATIONS

"We Believe" by C. C. Johnson Spink, *The Sporting News,* Sep. 5, 1970.

"Bases Stay Basic White", *Washington Post,* Dec. 2, 1970, p. D1.

*Primary Examiner*—Anton O. Oechsle

*Attorney, Agent, or Firm*—Allegretti, Newitt, Witcoff & McAndrews, Ltd.

[57] ABSTRACT

An improved base includes a base pad member having a flange plate attached to the bottom thereof for cooperation with a flat plate mounted on a post inserted in the ground. The base plate may thus slide onto the ground plate in order to retain the base in position. The base has a special oversized, generally rectangular construction so that a portion of the base projects beyond the first base foul line where it may be tagged by a runner. The remainder of the base is positioned inside the foul line in the normal base position for tagging by a fielder. The separate parts of the base are preferably denoted by distinctive color or design. This configuration promotes safety.

2 Claims, 3 Drawing Figures

BALL BASE CONSTRUCTION AND ANCHOR

BACKGROUND OF THE INVENTION

This invention relates to an improved ball base construction and more particularly to the configuration of first base as well as a base mounting structure for attaching any base.

Ball bases, such as baseball bases, are generally square in shape and fabricated from a variety of materials including canvas filled with a packing, vinyl, rubber, urethane, and other plastics which are molded and/or filled with packing. Typically, a strap is affixed on the lower side of the base. The strap is generally threaded through the looped end of a metal rod. The rod is then driven into the ground to hold the base in position. One or more metal rods may be used to stabilize the base in a desired position. Alternatively, the base may include a depending rod which telescopes into an opening or rod in the ground.

Each base in a ball game except homeplate has the identicial size and is positioned at the appropriate first, second and third base positions as determined by the league involved and local rules. Both the first and third base bases are, according to the rules, placed with one edge lying on the foul line and the remainder of the base lying inside of the foul line.

The inventors have observed that particularly at first base such an arrangement tends to cause collisions and/or injuries. That is, the base runner who is advancing after a hit is obliged to tag the first base bag before a fielder tags that bag. As a result, both the base runner and the fielder are often advancing toward the same bag on a collision course which in some instances may cause injury due to spiking or tripping, etc.

Also, it has been noted that the base may not be retained in a stable position due to the mechanism for attaching the base in place. When a base does become askew, again, the possibility for collision and injury becomes enhanced.

It is against this background that the present invention was devised and perfected.

SUMMARY OF THE INVENTION

Briefly, the present invention comprises an improved ball base having an improved means for attaching the base in position. The base itself has an oversized rectangular configuration so that a portion may extend outside the foul line at the first base position and the remainder may be positioned inside the first base line in the normal position of a base. Preferably, the portions inside and outside of the base line or foul line are distinguishable by means of color or other indicia. Also, preferably, the separate portions of the base are equal sized.

The base of the present invention is positioned and retained attached to the ground by means of a special attachment construction comprised of two interlocking plates, one of which is attached to the base and the other of which is attached to a post inserted in the ground. The separate plates may be slidably engaged or disengaged to remove or replace the base. The mounting structure may be used in combination with the special first base construction described or with a normal base construction.

Thus, it is an object of the invention to provide an improved ball base construction particularly with respect to first base.

A further object of the present invention is to provide an improved base attachment mechanism.

Still a further object of the present invention is to provide an improved base construction which will enhance the utility and safety associated with playing the game of baseball or other ball games.

One further object of the present invention is to provide a base construction which is especially useful as a first base particularly in softball.

Another object of the present invention is to provide a base construction which is economical to manufacture, easy to use and durable.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
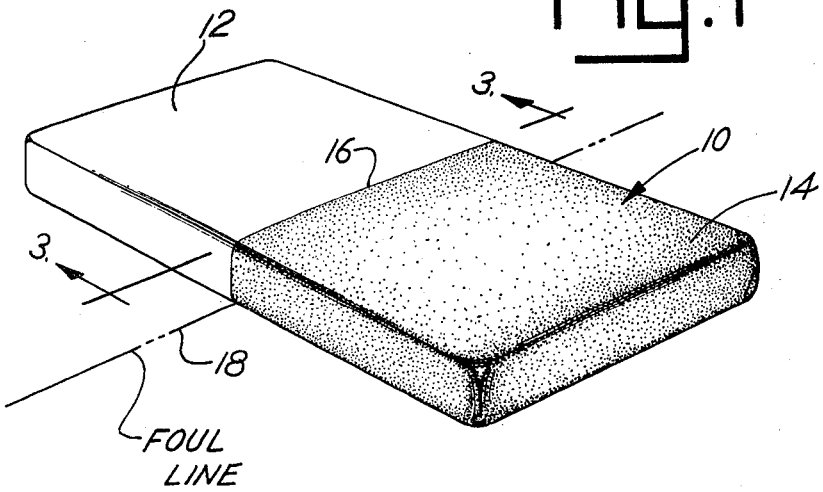
FIG. 1 is a perspective view of the improved base of the present invention as positioned at first base.

Referring to the figures, the improved base of the present invention includes various features and characteristics which may be utilized separately or in combination. For example, as shown in FIG. 1, the base 10 of the present invention contemplates an oversized, generally rectangular shaped base pad which includes first and second subsections 12 and 14, respectively. The base pad 10 in FIG. 1 is especially useful at the first base position. Thus, subsection 12 is a generally square regulation size base pad configuration. As generally required by the rules of baseball, the first subsection 12 is positioned with one side, i.e., the middle of the pad 10 coincident with the edge of a foul line 18. The second subsection 14 then rests outside of the foul line 18. As shown in the drawing, FIG. 1, the second subsection 14 is of like size and shape as the first subsection 12. Thus, however, is not to be taken as a limitation of the invention. The second subsection 14 may be of any desired size or shape. Importantly, the second subsection 14 projects and remains on the outside of the foul line 18.

Thus, when in use, the base pad 10 has a first subsection 12 to which the fielder will run and touch in order to effect an out. The second subsection 14, however, is for the purpose of being touched or entering into play by the base runner. In this manner the base runner will go to the second subsection 14. The fielder will go to the first subsection 12. As a result, the runner and the fielder will not engage in a collision course and the chance of being spiked or becoming involved in an injury due to a collision is greatly reduced. This is especially important to all levels of ball players.

To further enhance the differentiation between the subsections 12 and 14, each subsection may include a separate and distinct indicia. For example, subsection 12 may be standard white or canvas color associated with a typical base. Subsection 14 may be of a distinct color, orange for example. This will help distinguish the separate parts of the base.

Figure 2:
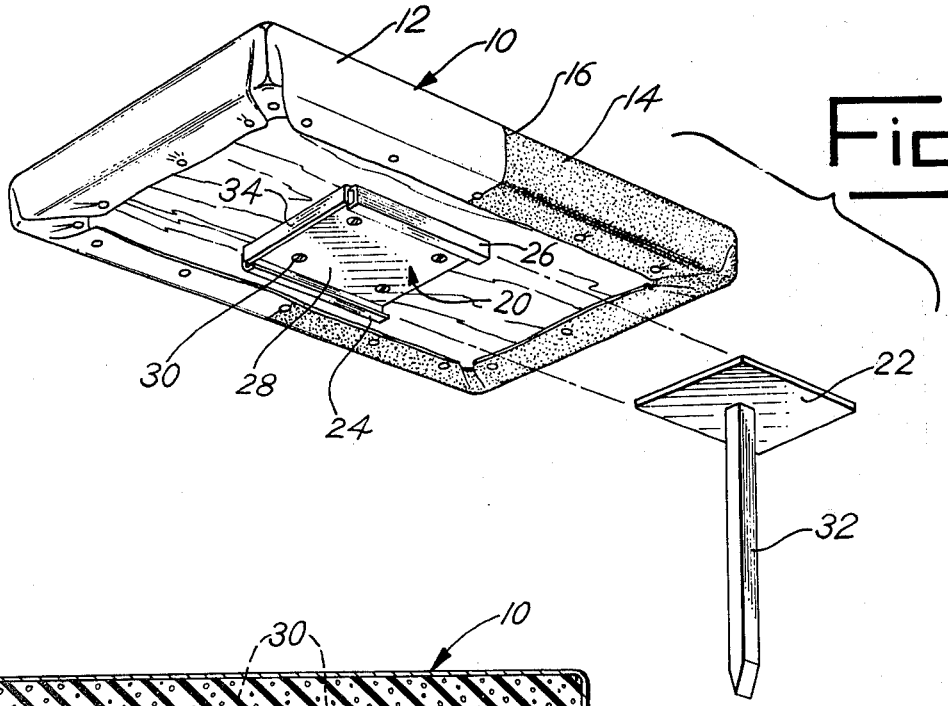
FIG. 2 is an exploded perspective view of the improved base construction shown in FIG. 1.
Figure 3:
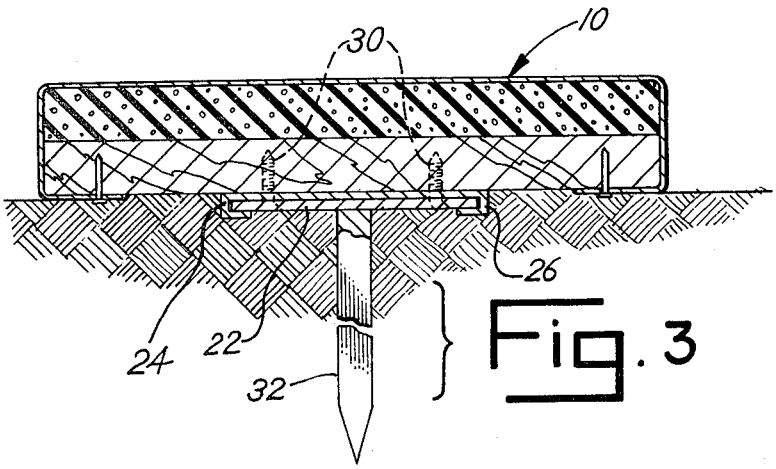
FIG. 3 is a cross sectional view of the improved baseball base construction of the present invention.

FIGS. 2 and 3 illustrate a further feature of the invention, namely, a particular mechanism associated with fastening or attaching the base to the ground so that it will be positioned rigidly yet safely with respect to a base runner and fielder. The specific fastening construction of FIGS. 2 and 3 may be incorporated with a base of the type shown in FIG. 1 which is an oversize base as compared with present day base constructions. Alternatively, the attachment construction could be used in combination with bases of any size or shape. FIG. 3 also illustrates the construction of the pad 10. The pad 10 comprises a pad support 11 and a cover 13 stretched over the pad support 11.

Referring to FIGS. 2 and 3, the attachment mechanism is comprised of a flanged plate 20 which cooperates with a planar or flat plate 22. In the embodiment shown, the flanged plate 20 includes depending side flanges 24 and 26 which project downwardly for a small distance from the main plate 28. The main plate 20 is affixed to the underside of the base 10 by means of fasteners such as screws 30.

An alternative construction utilizes a plate with the depending side flanges spaced inwardly from parallel edges of the plate. The screws 30 would then fasten through openings along the outside edge of the plate.

The planar plate member 22 includes a depending post 32 which is shaped so that it may be driven into the ground and hold the plate 22 rigidly in position at ground level or just below ground level. The base 10 and more particularly the flanged plate 20 may then be inserted or slid onto the plate 22 to retain the base 10 in position. In order to prevent the base 10 from sliding beyond the edge of the plate 22, a stop or flange 34 in FIG. 2 may be provided as depending from the planar plate 28. To insure that the base will be retained in position, the plate 22 as well as the plate 20 may be positioned along the base path in such a manner that a runner or fielder hitting the base will not slide the base from the plate.

It is possible to vary the construction of the combination described without varying from the scope of the following claims. For example, the specific construction of the flanged plate 20 and flat plate 22 may be varied. Additionally, the position of the plate 22 with respect to the plate 30 may be reversed. That is, the plate 22 may be affixed in a spaced manner to the base 10 whereas the plate 20 may be attached to the post 32. Also, more than one post 32 may be utilized to anchor the base plate 22.

The base may be any size, thickness and material and may be used for any ball game and for any non-league or league play from little league through major league play. The double sized rectangular base is especially useful as a first base in baseball play and may be used in combination with any type of fastening means for retaining the base on the field.

Thus, while there has been set forth a preferred embodiment of the invention, it is to be understood that the invention is to be limited only by the following claims and their equivalents.

What is claimed is:

1. An improved ball base comprising, in combination:

a unitary base pad member having a rectangular shape and divided into two substantially square or rectangular subsections, the paid member further comprising a pad support and a pad cover, each of said subsections including visually distinctive and different coloring of the covering of each subsection, each subsection being monochromatic with one subsection being substantially white and the other being a distinctive, bright color; and means for attaching the pad member to the ground to retain one subsection inside an imaginary line defined as the foul line and the other subsection simultaneously outside said line, whereby a runner may tag the outside subsection and a baseman can tag the inside subsection, said means for attaching comprising cooperative plates attached respectively to the bottom center of the base and to a rod member which projects into the ground, the plate attached to the base having side flanges and an end flange, with the side flanges formed into grooves matable with the second plate to slidably receive the second plate, the end flange comprising a stop flange perpendicular to the side flanges, the plates being mounted to slide transverse to the direction of an incoming base runner whereby a thrust from a base runner will not produce movement of the second plate in the grooves and thrust produced by a first baseman's foot will be resisted by the stop flange.

2. An improved ball base comprising, in combination:

a unitary rectangular base pad member divided into two sharply defined, equally sized square subsections, each subsection being the size of a regulation base with each subsection having visually distinct monochromatic color and a sharp, straightline boundary therebetween, one section being designated for the fielder and the other section being designated for the runner;

a rod member for securing the base to the ground with the foul line coincident with the boundary, the rod member comprising an elongated bar impact-drivable into the ground; and a connection system for securing the rod member to the base paid member, and thereby for securing the boundary coincident with a foul line with the fielder's section in the field of play and the runner's section outside the field of play, the connection system comprising a lower plate affixed to the rod member, and a cooperative upper plate affixed to the approximate center of the base pad member's lower surface, the upper plate having side flanges paralleling the base pad member's longer sides and forming opposed grooves for tongue and groove insertion of the lower plate into the grooves parallel to the upper plate, the upper plate also having a stop flange depending from the upper plate transverse to the side flanges and positioned at an upper plate edge to limit sliding of the lower plate in the upper plate side flange grooves, whereby the rod member and lower plate may be driven into the ground and the base member may be removably attached to the ground by sliding the lower plate as a tongue into the grooves of the upper plate side flanges until the lower plate rests against the stop flange aligning the base with the first base foul line so that the sharp transition between each subsection's colors corresponds with the foul line and a base runner may run to a base subsection different from the subsection contacted by a baseman.

* * * * *